US006683522B2

(12) United States Patent
Walsh

(10) Patent No.: US 6,683,522 B2
(45) Date of Patent: Jan. 27, 2004

(54) PLANAR MINIATURE INDUCTORS AND TRANSFORMERS

(75) Inventor: Joseph G. Walsh, Brookline, MA (US)

(73) Assignee: Milli Sensor Systems & Actuators, Inc., West Newton, MA (US)

( * ) Notice: Subject to any disclaimer, the term of this patent is extended or adjusted under 35 U.S.C. 154(b) by 182 days.

(21) Appl. No.: 09/861,736

(22) Filed: May 21, 2001

(65) Prior Publication Data

US 2001/0052837 A1 Dec. 20, 2001

Related U.S. Application Data

(63) Continuation-in-part of application No. 09/257,068, filed on Feb. 24, 1999, now Pat. No. 6,233,834.

(51) Int. Cl.[7] ..... H01F 38/20; H01F 17/06

(52) U.S. Cl. ..... 336/175; 336/176; 336/174; 29/602.1

(58) Field of Search ..... 336/174, 175, 336/176, 212, 220, 222; 29/602.1, 606, 607

(56) References Cited

U.S. PATENT DOCUMENTS

| | | | | | |
|---|---|---|---|---|---|
| 3,750,071 | A | * | 7/1973 | Eley | 336/84 R |
| 3,835,430 | A | * | 9/1974 | Kocsis | 336/83 |
| 4,684,882 | A | * | 8/1987 | Blain | 323/356 |
| 5,321,373 | A | * | 6/1994 | Shusterman et al. | 333/12 |
| 5,737,211 | A | * | 4/1998 | Hirai et al. | 363/144 |

* cited by examiner

*Primary Examiner*—Anh Mai
(74) *Attorney, Agent, or Firm*—Brian M. Dingman, Esq.; Mirick, O'Connell, DeMallie & Lougee LLP

(57) ABSTRACT

The planarization of inductive components by reducing standard coiled designs to single turn, open ended designs from which the required parameters are obtained by scaling the length. Single turn designs having magnetic material encircling the conductors along their full length enable the thinnest form. The single turn, open ended form also enables the inductive component to be routed according to any shape in the plane or on any conformal surface. The single turn inductors do not need to coil hence there is no overlap necessary in the plane. The planar form allows integration of inductive components with integrated circuits. These inductive components can be embedded in other materials. They can also be fabricated directly onto parts.

47 Claims, 14 Drawing Sheets

*PRIOR ART*

PLANAR MINIATURE INDUCTORS AND TRANSFORMERS

CROSS REFERENCED TO RELATED APPLICATION

This application is a continuation in part of application Ser. No. 09/257,068, filed on Feb. 24, 1999, U.S. Pat. No. 6,233,834. Priority is claimed.

STATEMENT OF FEDERALLY SPONSORED RESEARCH AND DEVELOPMENT

This invention was made with Government support under contract number DTRA01-99-C-0186 awarded by BMDO. The Government has certain rights in the invention.

FIELD OF THE INVENTION

This invention relates to planar inductive components.

BACKGROUND OF THE INVENTION

Traditional Approach to Planar Transformers

Planar inductive components fabricated in multi-layered fashion have been published in the MEMS literature. FIG. 1 shows in exploded view a multi-layered design for a toroidal concept 10 which is typical for the state-of-the-art. Coil windings 14 are wound about the magnetic core 11 (thin circular flat ring). Separating the coils from the core are insulating layers 12, 13. For the toroid requiring magnetic laminations, the core is formed from multiple flat rings separated by non-magnetic, insulating layers. Note that the coil windings require electrical connections between the top 15 and bottom 16 segments.

The difficulties with this approach are numerous and relate to the practicality of fabrication:

a. The number of coil turns is limited by the diameter of the ring core and the ability of the fabrication process to fabricate high aspect ratio vertical coil segments.
b. The alignment requirement to connect the top and bottom segments of the coil about the core needs to be extremely precise, given the small dimension of the conductor cross-section, in order to prevent shorts and opens.
c. The connection quality between top and bottom segments of the coil becomes a significant source of electrical resistance when considering the large number of turns that may need to be connected.
d. The possibility for an open connection at one of the coil interfaces is large and renders the component unusable.
e. Leakage flux occurs since the coil turns do not totally enclose the magnetic core.
f. In the case of the DCT transformer, the difficulty in carrying out the coil construction makes it difficult to match the primary turns.

Successful fabrication of this design would require very high precision, high aspect ratio equipment and processes with very high yield risk because only one short or one open renders the component useless. The high yield risk becomes even more impractical when considering integration with ICs and packaging.

SUMMARY OF THE INVENTION

This invention addresses planar inductive components based on a linear, thin design topology that enables greater flexibility in how the components are applied, structurally and electrically. The fabrication method is multi-layered based on a layer-by-layer construction to achieve a monolithic form. Microelectromechanical Systems (MEMS) approaches based on photolithographic patterning, etching of molds and deposition can be used. Many variations on this approach are possible and depend on whether the components are formed onto macro parts, integrated with or under Integrated Circuits, embedded in circuit boards or packaging, formed separately for pick and place applications, etc.

The inductive components are linear because their inductance varies proportionately with length. Unlike wire-wound inductive coils that occupy an appreciable volume on a circuit board due to their bulkiness, the linear devices of this invention are not required to begin and end at particular locations, are wire-like and can be meandered in the plane to fit into a designed space.

The planar topology of this invention is practical to fabricate, enabling large scale production and low cost.

The inductive components of this invention include inductors, transformers, differential current transformers (DCT), isolation transformers, chokes, filters, mixers, etc.

This invention features an elongated, planar, generally linear electrical inductive component, comprising: at least one conductor, each conductor defining a unique conductive path; a magnetic core co-linear with all conductors along the entire component length, and completely surrounding all conductors; and an insulator separating each conductor from any other conductor and from the magnetic member; wherein at any location along the length of the component, in cross section the component includes only one conductor for any conductive path.

The component may comprise a single conductor, to accomplish an inductor. The magnetic core may define a magnetic circuit comprising a gap. The conductor may define a gap along its entire length, to create two full-length top and bottom halves, to allow for differential thermal expansion. The insulator may be accomplished in part by a space, to reduce the component capacitance.

The component may comprise two conductors, to accomplish a transformer, or three conductors, to accomplish a differential current transformer. The component may comprise more than two conductors to accomplish a step up or step down transformer with a desired voltage transformation from the input or inputs to the output or outputs.

The magnetic core and all conductors may meander through a plurality of turns, to increase the component's effective length. The meanders may be essentially parallel. The magnetic core may comprise a plurality of laminations separated by non-magnetic insulating material, each lamination completely surrounding all of the conductors.

The component may comprise two or more stacked layers of meanders, to increase the conductor and core length. The component may directly connect between two spaced components in an electrical circuit, to both accomplish a desired inductance as well as carry current between the two spaced components. The invention also features a multiple inductive component inductive circuit comprising a plurality of inductive components of the type described herein, connected in a desired series and/or parallel circuit combination, to achieve a desired inductance value or voltage conversion.

Also featured is a method of fabricating this component, comprising: fabricating two essentially identical halves, each defining one half of the component; and mechanically and magnetically coupling together the two halves, to create the component.

In another embodiment, the invention features a method of fabricating an elongated, planar, generally linear electrical inductive component by multi-layered fabrication, the component having at least one conductor, each conductor in the component defining a unique conductive path, a magnetic core co-linear with all conductors along the entire component length, and completely surrounding all conductors, and an insulator separating each conductor from any other conductor and all conductors from the magnetic core member, wherein at any location along the length of the component, in cross section the component includes only one conductor for any conductive path, the method comprising: providing a lower layer of magnetic core material; providing on top of the lower layer of magnetic core material, a bottom insulator layer; providing on top of the bottom insulator the at least one conductor; providing an insulator adjacent to the outside and top of each conductor; providing, spaced to the outside of the at least one conductor and the adjacent insulator, vertical segments of the magnetic core, in contact with the lower layer of magnetic core material; and providing over the upper insulator and in contact with the magnetic core vertical segments, an upper magnetic core material, to complete a magnetic core circuit.

Also featured is a method of fabricating an elongated, planar, generally linear electrical inductive component by multi-layered fabrication, the component having at least one conductor, each conductor in the component defining a unique conductive path, a magnetic core co-linear with all conductors along the entire component length, and completely surrounding all conductors, and an insulator separating each conductor from any other conductor and all conductors from the magnetic core, wherein at any location along the length of the component, in cross section the component includes only one conductor for any conductive path, the method comprising: fabricating two component halves, each half made by: providing a lower layer of magnetic core material; providing on top of the lower layer of magnetic core material, a bottom insulator layer; providing on top of the bottom insulator layer the at least one conductor; providing an insulator adjacent to the outside of each conductor; providing, spaced to the outside of the at least one conductor and the adjacent insulator, vertical segments of the magnetic core, in contact with the lower layer of magnetic core material; and planarizing the top surface of the construction; and then mechanically and magnetically coupling together the planarized surfaces of the two halves, to complete the component.

In another embodiment, the invention features a method of fabricating an elongated, planar, generally linear electrical inductor by multi-layered fabrication, the inductor having a single conductor, a magnetic core co-linear with the conductor along the entire component length, and completely surrounding the conductor, and an insulator separating the conductor from the magnetic core, the method comprising: fabricating two component halves, each half made by: providing a lower layer of magnetic core material; providing spaced vertical segments of the magnetic core, in contact with the lower layer of magnetic core material; providing a bottom insulator layer on top of the lower layer of magnetic core material and the spaced vertical segments; providing the conductor on top of the insulator; and planarizing the top surface of the construction; and then mechanically and magnetically coupling together the planarized surfaces of the two halves, to complete the component.

In yet another embodiment, the invention features a method of fabricating an elongated, planar, generally linear electrical inductor by multi-layered fabrication, the inductor having a single conductor, a magnetic core co-linear with the conductor along the entire component length, and completely surrounding the conductor, and an insulator separating the conductor from the magnetic core, the method comprising: providing an elongated conductive wire having an essentially circular cross-section; coating the wire with a non-magnetic insulation layer; and coating the non-magnetic insulation layer with a first layer of magnetic core material. This method may further comprise creating a plurality of laminations in the magnetic core by sequentially coating the first layer of magnetic core material with one or more laminations, each comprising a coating of non-magnetic insulating material and then a coating of magnetic core material on top of the coating of non-magnetic insulating material.

BRIEF DESCRIPTION OF THE DRAWINGS

Other objects, features and advantages will occur to those skilled in the art from the following descriptions of the preferred embodiments, and the accompanying drawings, in which.

DESCRIPTION OF THE PREFERRED EMBODIMENTS OF THE INVENTION

This invention eliminates the need to form conductor coil windings about a magnetic core in the fabrication of inductive components. Instead, the magnetic core is formed about the conductor, or a set of conductors, encircling them along the full component length. The conductors are separated from each other and the magnetic core by electrically insulating material. The topology can be wire-like having a cross-section that is essentially uniform along the device length and the desired inductance is achieved by varying the length. The conductors, insulators and magnetic core are collinear. For each application, the design process determines the cross-section dimensions and the materials, which will determine the Q. The thinness of the component results from the cross section dimensions.

Figure 1:
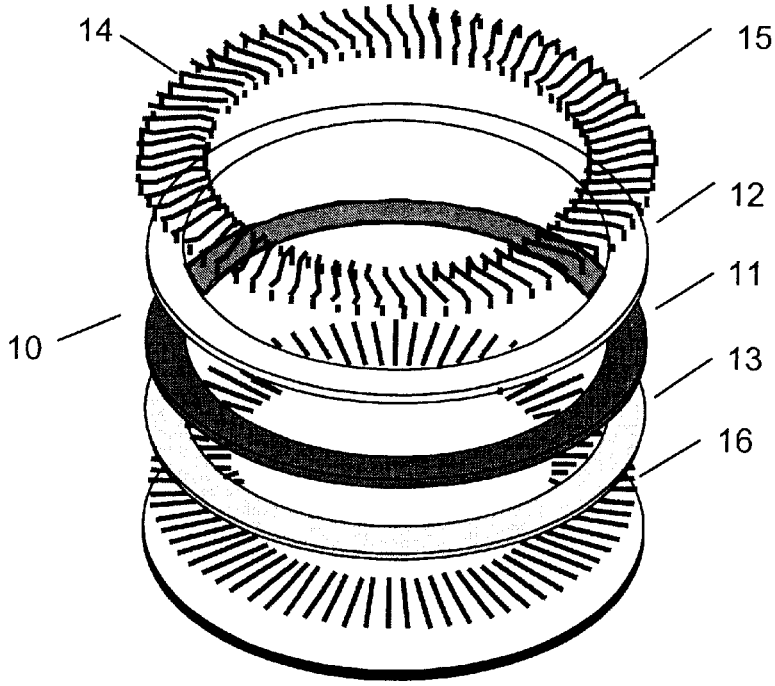
FIG. 1 is an exploded view of a planar, toroidal transformer fabricated using photolithographic patterning, etching and additive processes.
Figure 2:
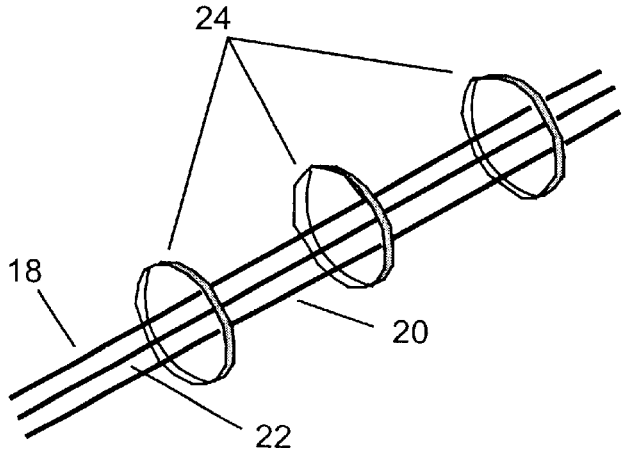
FIG. 2 is a schematic illustration of the DCT invention.

The concept can be understood by referring to FIG. 2 which depicts a three conductor DCT. Two conductors form the primary windings (albeit straight) 18, 20 and the single secondary winding 22. All three conductors pass through circular magnetic cores 24.

Planar Inductive Components

Differential Current Transformer

Figure 3:
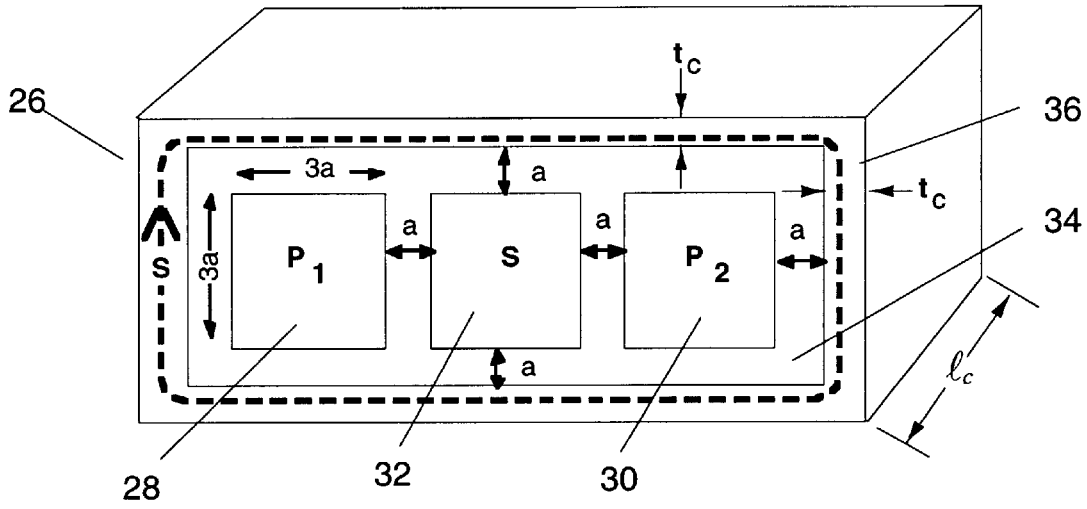
FIG. 3 is a view of a conceptual cross-section of the DCT having unit length.

FIG. 3 describes the cross-sectional view of a differential current transformer (DCT) 26 having unit length. It includes three conductors: two for the primary circuit 28, 30 and one for the secondary 32. The conductors are separated by electrically-insulating material 34 and the conductors and insulators are surrounded by a magnetic core 36, made of suitable material.

The relevant dimensions are: the magnetic circuit length, s, the thickness of the magnetic core, $t_c$, the conductor width and height, both 3*a* in this case, and the separation between conductors, a in this case.

The relevant material properties are the conductor resistivity, ρc, and the magnetic material permeability, $\mu_r\mu_o$.

The frequency of operation is also important because it limits the effective thickness of the magnetic core to twice the skin depth as a result of eddy currents.

The values of the geometric parameters of the device cross-section will depend on the material properties and achievable fabrication tolerances in fabricating the different features of the device.

Analytically the inductance and Q of the device may be derived as follows. The device described by FIG. 3 consists of a symmetric, closed magnetic circuit of length s (dotted line). From Ampere's Law, the line integral of the magnetic field, H, along the encircling core is equal to the current, i, that it encloses.

$$\oint \overline{H}\cdot d\overline{s}=Hs=I \tag{1}$$

The magnetic flux density, B, is related to H by $B=\mu_r\mu_o H$ where $\mu_r$ is the relative permeability and $\mu_o$ the permeability of free space. The flux in the magnetic circuit is then given by the integral of the flux density $$\Phi = \int_A \overline{B}\cdot d\overline{A} = BA = Bt_c l_c \tag{2}$$

where $A=t_c l_c$ is the cross-sectional area which the flux crosses.

The inductance is given by the ratio of the flux linking the conductor to the current, i. Since the flux linkage for this design is equal to the flux, Φ, the inductance is given by $$L = \frac{\Phi}{i} \tag{3}$$

Using the results of the above expressions, the inductance can be written as $$L = \frac{\Phi}{i} = \mu_r\mu_o\frac{t_c l_c}{s} \tag{4}$$

in terms of geometric parameters and material properties.

The quality factor, Q, for an inductor without core losses is given by $$Q = \frac{L\omega}{R_s + R_A} \tag{5}$$

where $R_s$ and $R_a$ are the transformer conductor and secondary load resistances, respectively and ω is the angular frequency of the excitation.

An interesting and convenient result for the Q is obtained when the quality factor expression is rewritten in terms of geometric parameters, assuming a negligible secondary load resistance, $R_a$. The Q becomes $$Q \cong \frac{9\mu_r\mu_o t_c a^2\omega}{s\rho_c} \tag{6}$$

where the transformer resistance, $R_s$, is replaced by the expression $$R_s = \frac{\rho_c l_c}{9a^2} \tag{7}$$

The Q is seen to be independent of length, therefore the resistance and the inductance can be determined per unit length and the only relevant geometric parameters are those of the cell cross-section.

The formulas above assume that the thickness of the magnetic core are less than the skin depth δ, the depth of penetration of the magnetic field in the core or Nδ in the case where laminations are used to ensure that the magnetic flux, ϕ, fully penetrates the core.

The skin depth δ is given by $$\delta = \sqrt{\frac{2\rho_m}{\mu_r \mu_o \omega}} \tag{8}$$

where $\mu_r$=relative permeability $\mu_0$=permeability of free space ($4\pi\times10^{-7}$ Henries/meter)

$\rho_m$=resistivity of the magnetic material $\rho_c$=conductor resistivity (copper $1.72\times10^{-8}$ ohm/meter)

$\omega=2\pi f$ (where f is the frequency of applied fields)

Figure 4:
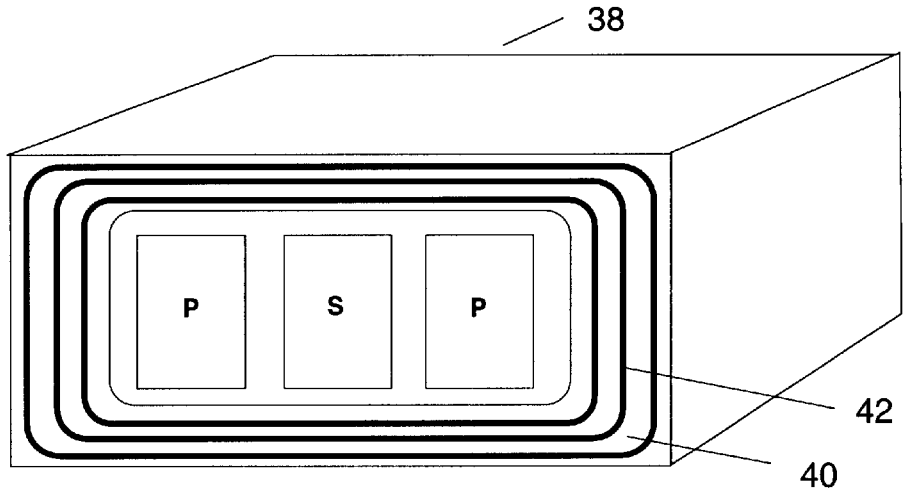
FIG. 4 is a view of a conceptual cross-section of the DCT of unit length with magnetic laminations included to reduce eddy currents.

FIG. 4 shows a differential current transformer 38 constructed with magnetic laminations 40 to reduce the effects of eddy currents, which were ignored in the preceding development. A non-magnetic, insulating material 42 separates individual laminations.

From equation 6, Q can be maximized by:

a. increasing the magnetic core thickness, $t_c$, and hence core cross sectional area, b. reducing the magnetic circuit length, s, but that depends on the conductor dimensions, c. increasing the conductor cross section and hence reducing the conductor resistance, $R_s$, d. increasing the core permeability, $\mu_r$ and e. reducing the conductor resistivity, $\rho_c$.

Other design considerations include:

a. saturation of the core, b. choice of electrical insulation material and spacing between inductors, c. choice of non-magnetic material for forming laminations, d. the capacitance between the conductors and between the conductors and the core which will define the self resonant frequency of the transformer or inductor, e. choice of core material and permeability, f. effects of stress on the inductive properties, g. effects of temperature on the inductive properties, h. lowest resistivity for the conductor material, i. uninterrupted magnetic circuit unless desired as in the case of gaps, j. impedance matching between windings in transformer designs The benefits of this invention include:

a. Ability to use low aspect ratio fabrication technology.

b. The conductors are continuous in the plane of the device; connections between conductors at different levels are not required.

c. Small magnetic material thicknesses may be used, which are within current fabrication capability.

d. Excellent matching for coupling between primaries and a common secondary is a natural result of the invention.

e. The magnetic field is contained within the magnetic core eliminating external flux leakage.

f. Coupling between conductors is unity by geometry.

g. The inductance of the DCT, inductors and other transformers of this invention can be determined per unit length; the total inductance is then determined by the total length, while the Q is independent of length.

h. The design is linear and is not restricted to a particular geometry and can in fact meander to fit in available spaces on the substrate.

One-to-One Ratio Transformer

Figure 5:
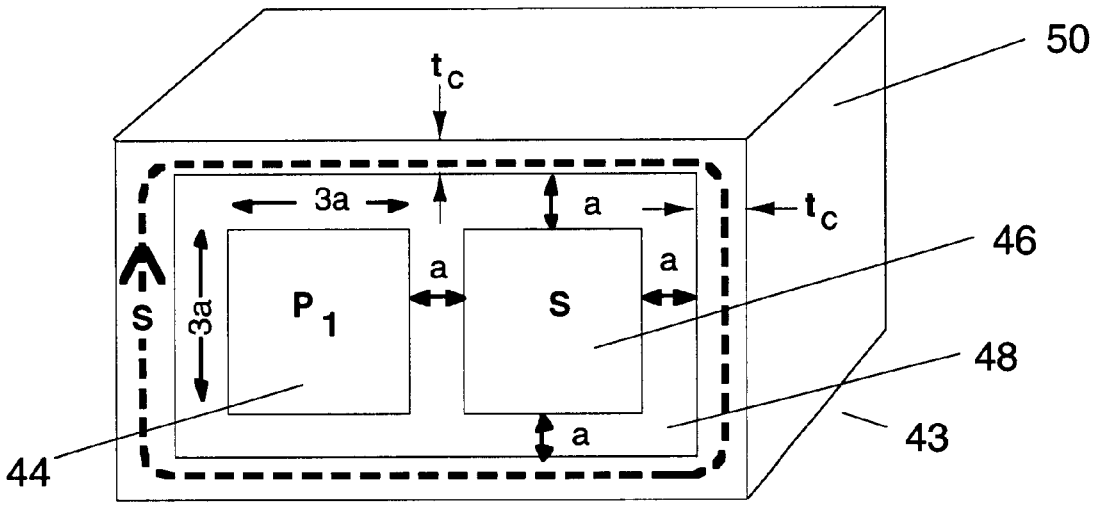
FIG. 5 is a view of a conceptual cross-section of a one-to-one ratio transformer of unit length.

A one-to-one ratio transformer 43 is shown in FIG. 5. It includes a single primary conductor 44 and a single secondary conductor 46. An insulator 48 separates the conductors from each other and the core. A magnetic material 50 encircles the insulator and conductors. Based on the dimensions shown in FIG. 5, the inductance, series resistance and capacitance between conductors are given by $$L = \frac{\mu_r \mu_o t_c l_c}{28a + \pi t_c} \tag{9}$$

$$R = \frac{\rho l_c}{9a^2} \tag{10}$$

$$C_{\mu s} = \varepsilon_r \varepsilon_o l_c \tag{11}$$

Inductor

Figure 6:
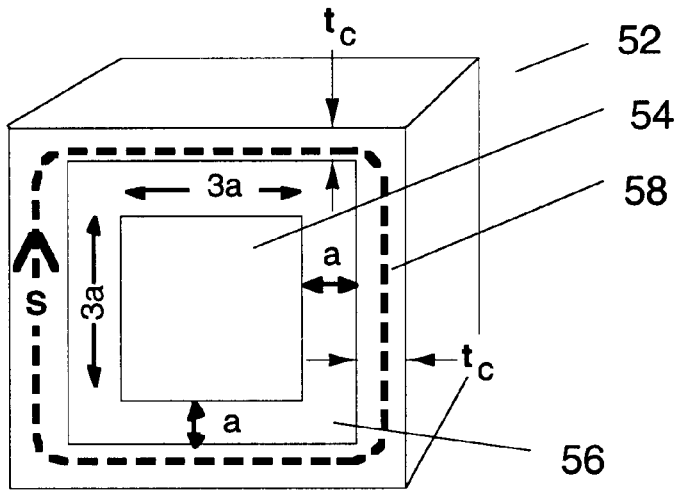
FIG. 6 is a view of a conceptual cross-section of an inductor of unit length.

An inductor configuration 52 is shown in FIG. 6. It consists of a single conductor 54 enclosed by an insulator 56. Both the conductor and insulator are encircled by the magnetic core 58. For this configuration, the calculations for the inductance, series resistance, and capacitance are $$L = \frac{\mu_r \mu_o t_c l_c}{20a + \pi t_c} \tag{12}$$

$$R = \frac{\rho l_c}{9a^2} \tag{13}$$

$$C = 12\varepsilon_r \varepsilon_o l_c \tag{14}$$

Figure 7:
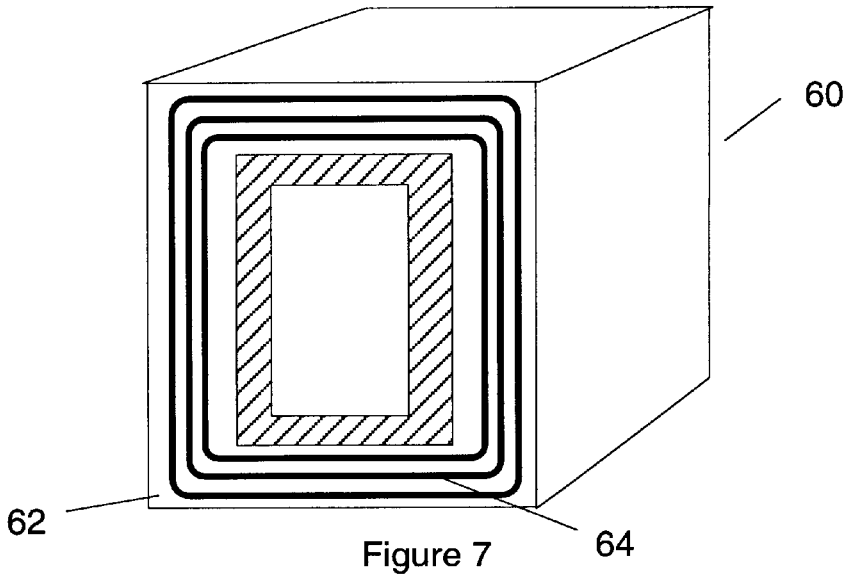
FIG. 7 is a view of a conceptual cross-section of an inductor with magnetic laminations included to reduce eddy currents.

FIG. 7 shows an inductor configuration 60 with 4 magnetic laminations 62. The laminations are separated by a non-magnetic, insulating material 64.

Inductor with Losses and Core Gap

Figure 8:
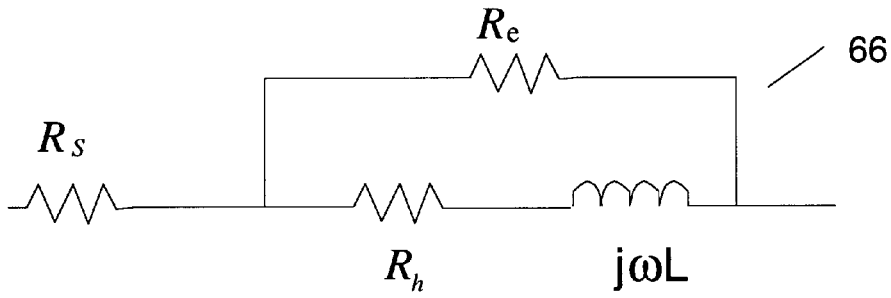
FIG. 8 is an electrical circuit model for an inductor having a gap in the core.
Figure 9:
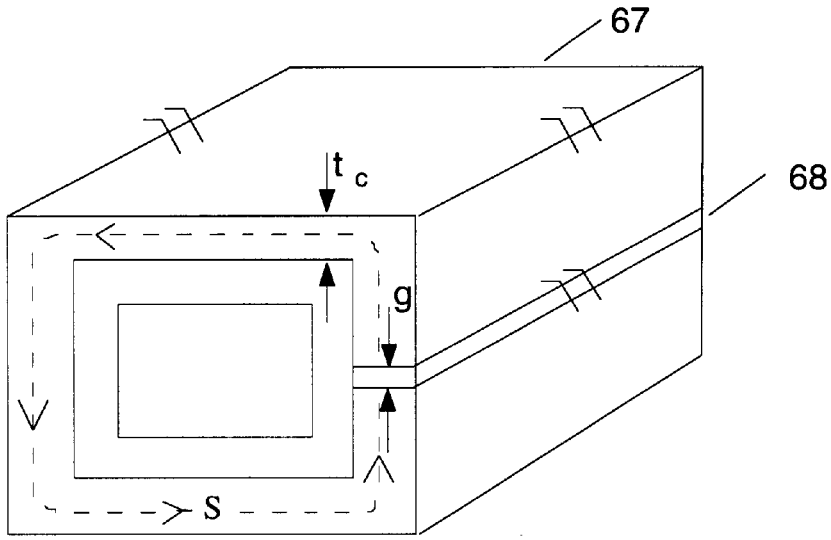
FIG. 9 is a view of a conceptual cross-section of an inductor with a gap in the magnetic core.

A more complete description of the inductor includes the effects of hysteresis and eddy current losses as well as the use of a gap in the magnetic circuit. An equivalent circuit 66 is shown in FIG. 8. It applies to the inductor configuration 67 shown in FIG. 9. A gap 68 is located in the magnetic circuit and extends the full length of the inductor in this case.

The conductor resistance, $R_s$, depends on the conductor resistivity, $\rho_c$, cross-sectional area, $A_c$ and inductor length, $\mathbf{1}_c$, as given by $$R_s = \frac{\rho_c l_c}{A_c} \tag{15}$$

The equivalent resistance contributed by eddy current losses depends on the path length, s, of the magnetic field in the core, the laminated core thickness, $t_c$, the magnetic core resistivity, $\rho_m$, and the number of laminations, N, is given as $$R_e = \frac{12\rho_c 1_c}{t_c s} \cdot (N+1)^2 \tag{16}$$

The equivalent resistance contributed by hysteresis losses is given by $$R_h = \frac{kL\omega}{2\pi(1+\mu_r g/s)} \tag{17}$$

where $$L = \frac{\mu_r \mu_o t_c l_c}{s+\mu_r g}$$

is the inductance, $\omega=2\pi f$ is the angular frequency for an excitation frequency of f, and g is the inductor gap. $\mu_o$ is the permeability in air and $\mu_r$ is the relative permeability of the magnetic material. k is a factor much less than one typically, which is dependent on the shape of the hysteresis loop. The inductance for the lossless inductor is given by $j\omega L$.

The quality factor, Q, is given by $$Q = \frac{L\omega}{R_s\left(\frac{R_e+R_h}{R_e}\right)+R_h\left(1+\frac{R_h}{R_e}\right)+\frac{(L\omega)^2}{R_e}} \tag{18}$$

For the inductor case it is desirable for these conditions to be met: $R_e \gg L\omega$ and $R_h \ll R_e$. The form for Q then reduces to $$Q = \frac{L\omega}{R_s+R_h+\frac{L\omega}{R_e}\cdot L\omega} \tag{19}$$

From this form it can be seen that for low frequencies the Q dependence goes as $$Q = \frac{L\omega}{R_s+R_h}$$

whereas for high frequencies Q tends to values less than one. It is therefore important to laminate as much as possible to keep $R_e \gg L\omega$ at the frequency of interest. The use of the gap also is useful in that it reduces the equivalent hysteresis loss.

Meandering Form

Figure 10:
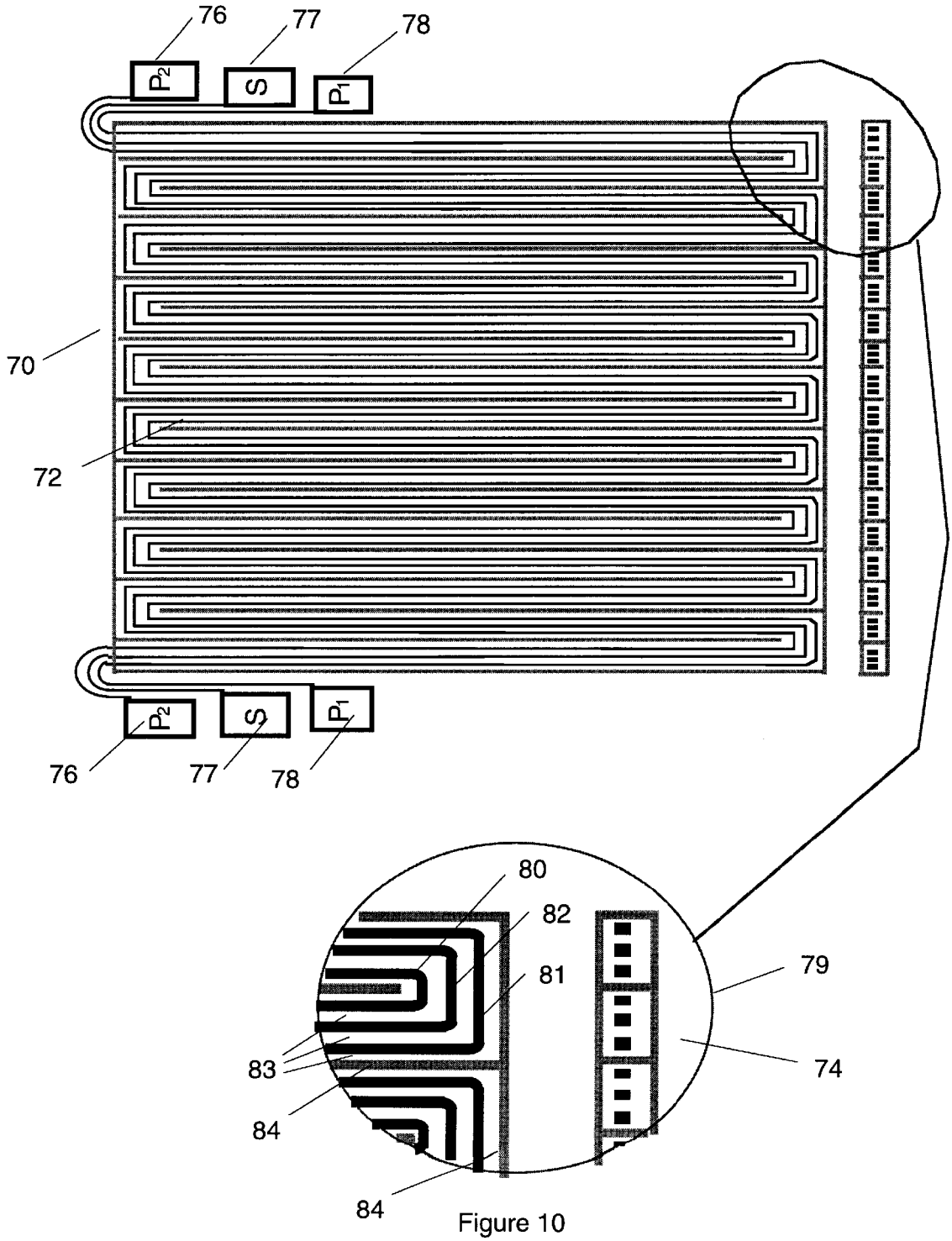
FIG. 10 is a conceptual rendition of a DCT transformer meandered to form a planar rectangular arrangement.

To achieve the desired inductance, the inductive component must have the proper length. A top view of the DCT 70 is shown in FIG. 10 for a rectangular device shape. The conductors and core are shown to meander 72 back and forth from side to side to achieve the necessary total length. The thin side cross-section 74 is shown. The external connections to the DCT can be made at the pads 76, 77, 78. In the meander detail shown in the enlarged view 79 are indicated a first primary 80, a second primary 81 and the secondary 82. The DCT is not limited to the rectangular shape shown, however, and can in fact meander along arbitrary paths and form any shape according to available space in the application. An electrical insulator 83 separates the conductors from each other and the conductors from the magnetic core 84.

Stack Construction

Figure 11:
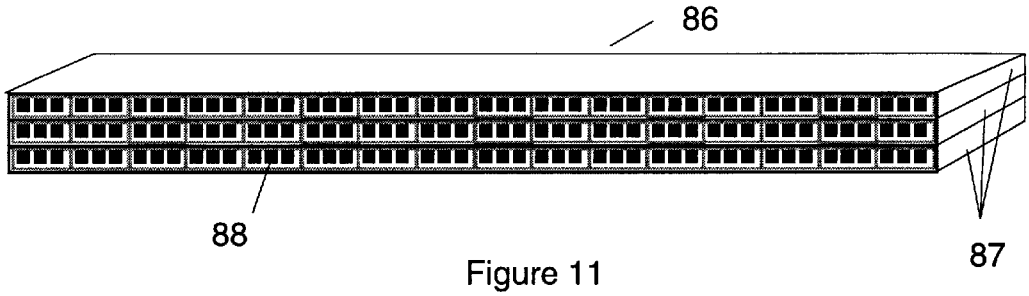
FIG. 11 is a view of a stack of connected layers, each layer of which is a transformer meandered to form a planar rectangular shape. The layers may be serially connected to achieve the proper transformer length.

In the case where the available surface area is not sufficiently large to allow the required conductor and core length to be formed, additional inductance can be obtained by repeating layers to form a stack 86; three levels 87 connected in series are shown in FIG. 11 for this DCT 88 example.

Uses of Inductive Building Blocks

Figure 12:
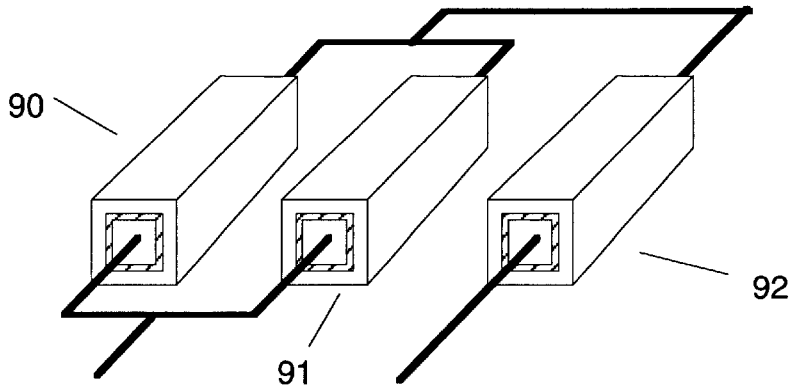
FIG. 12 is a conceptual rendition of a parallel/series connection of similar inductors to form a second inductance value.
Figure 13:
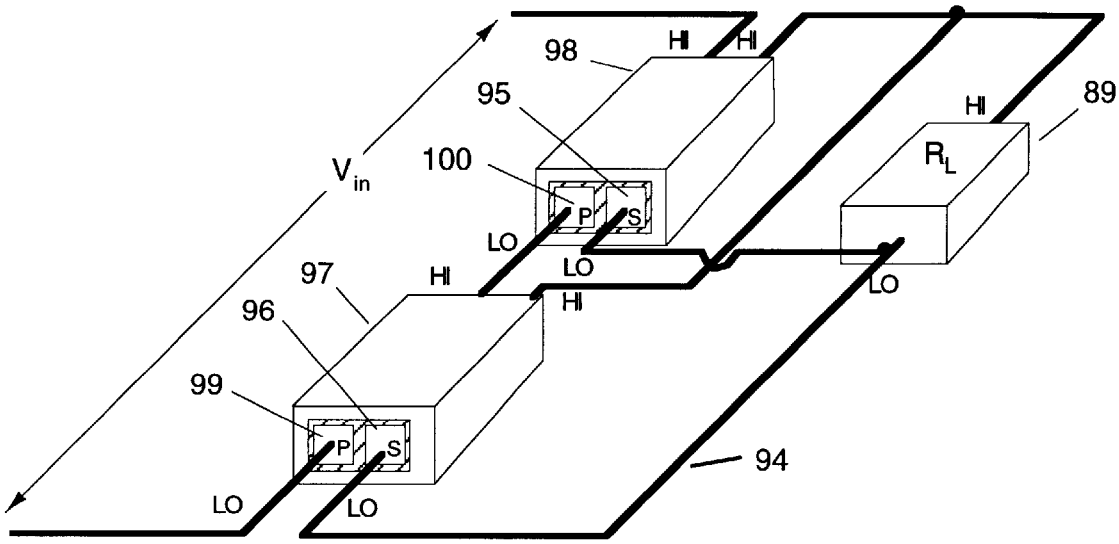
FIG. 13 is a conceptual rendition of two one-to-one voltage ratio transformers connected to form a two-to-one ratio step-down transformer by means of connecting the secondaries in parallel and connecting the primaries in series.
Figure 14:
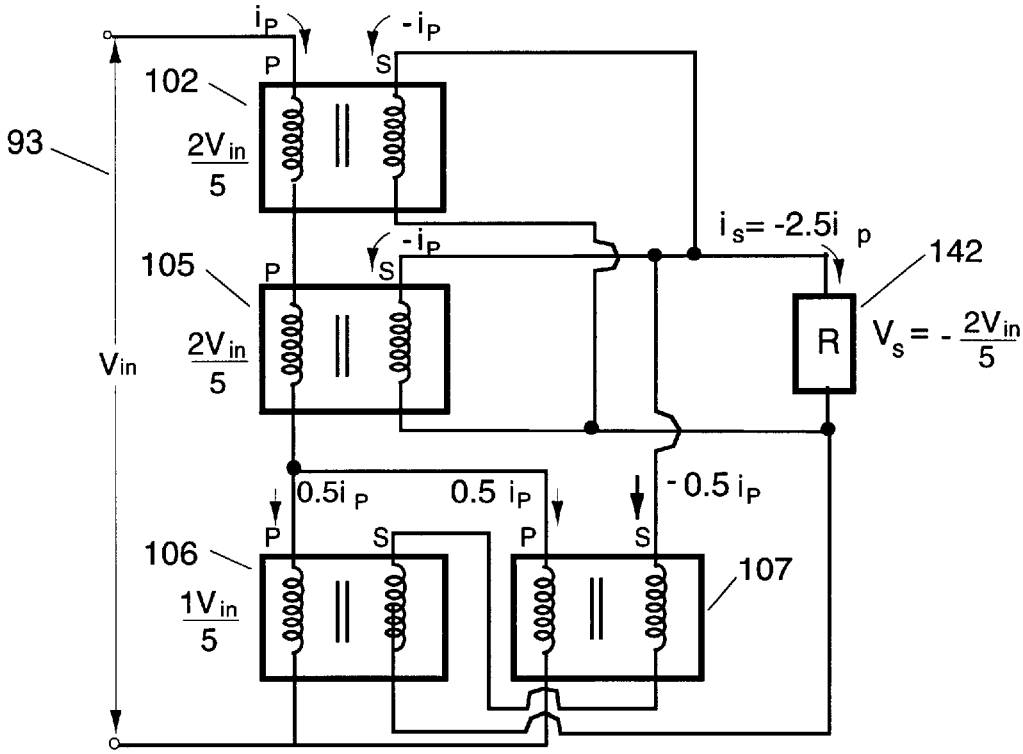
FIG. 14 is a conceptual rendition of connected primaries and secondaries of four one-to-one ratio identical transformers to form a step-down transformer of five-to-two voltage ratio.

It may happen that fabrication and cost considerations will drive the inductive component designs to standard size products with specified inductance values. These can then be connected to obtain inductance values required. FIG. 12 is an example of two inductors 90, 91 connected in parallel which are in turn connected in series with inductor 92 to yield an inductance value of 1.5 times that of an individual inductor. FIG. 13 is an example of a 2-to-1 step-down voltage transformer 94 which is formed by connecting in parallel the secondaries 95, 96 of two identical one-to-one ratio transformers 97, 98 and connecting in series the primaries 99, 100 of the same transformers. The output is connected to a load 89. FIG. 14 is a step-down voltage transformer 93 in the ratio of five to two. It includes four identical one-to-one ratio transformers 102, 105, 106, 107 with primaries and secondaries connected in the proper series/parallel combination. The output is attached to a load 142. Other step-up and step-down variations will occur to those skilled in the art.

Implementation of a Linear Inductive Component

Figure 15:
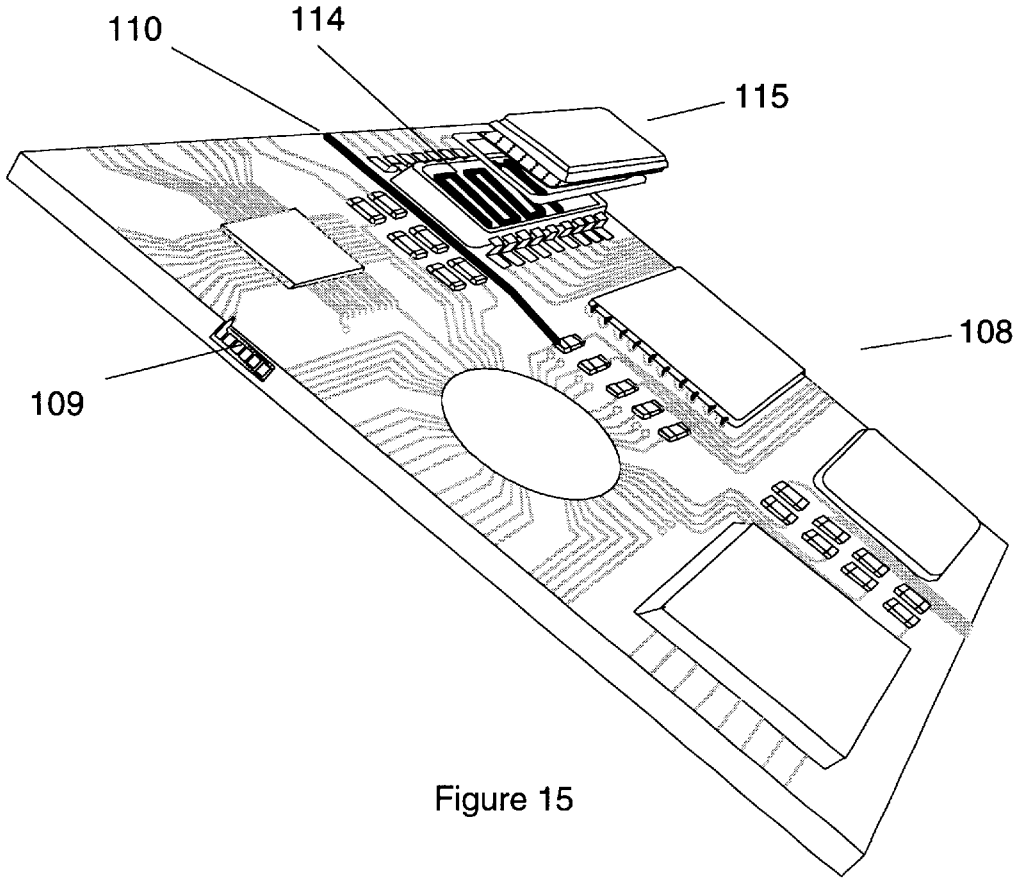
FIG. 15 demonstrates the utility of linear inductive components of this invention in an example circuit board in which the component can take the form of a connecting wire with inductance, as an inductive component imbedded within the board and as an inductive component structure formed on the surface of the board itself.

Because the inductive component is linear (wire-like), it offers flexibility in how it can be implemented in applications. FIG. 15 shows three examples carried out on a printed circuit board 108. The first example shows the inductive component 109 imbedded in the board. The second example shows the inductive component as an inductive wire 110 connecting two other components (it is an inductor as well as a connecting conductor). In addition, in the second example, the wire is fully shielded to reduce leakage (coupling with other circuits). In the third example, the inductive component is formed as a meandered planar component 114 to occupy a space on the board over which another component 115 can be located.

Inductive components can also be fabricated onto macro parts where the proximity provides an advantage. In sensor applications, the differential current transformer differences the signals prior to transmission to supporting electronics and therefore minimizes signal degradation by pick-up from external sources.

Sandwich Construction

Figure 16A:
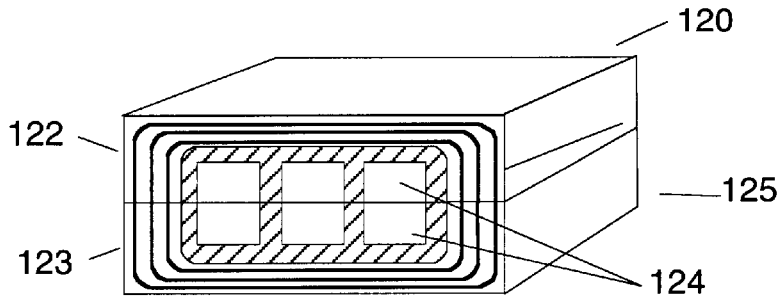
FIG. 16*a* is a view of a conceptual cross-section of a DCT formed by using sandwich construction.
Figure 16B:
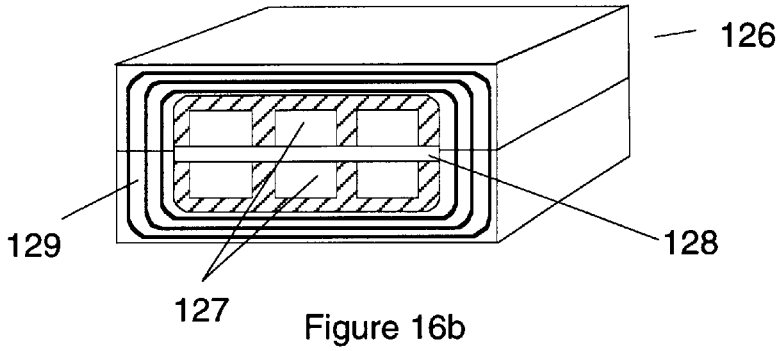
FIG. 16*b* is a view of a conceptual cross-section of a transformer having six conductors and formed by sandwich construction.

Inductive components such as the DCT 120 shown in FIG. 16*a* may be fabricated in two independently fabricated halves, a top half 122 and a bottom half 123, which are then joined. This method of construction may be preferred for some methods of fabrication. Note that the conductors 124 come into direct contact and the laminated magnetic cores 125 also come into direct contact. Another variation on the transformer design 126 separates the conductors 127 with an electrical insulator layer 128 while retaining intimate contact between the magnetic cores 129 as shown in FIG. 16*b*.

Figure 17A:
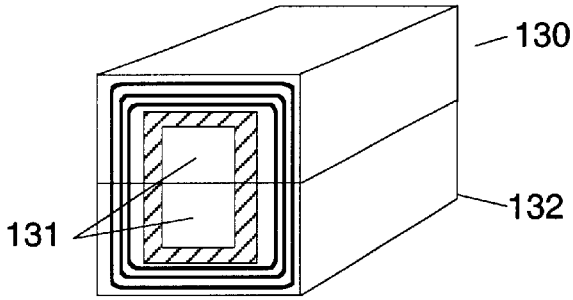
FIG. 17*a* is a view of a conceptual cross-section of an inductor formed by sandwich construction.
Figure 17B:
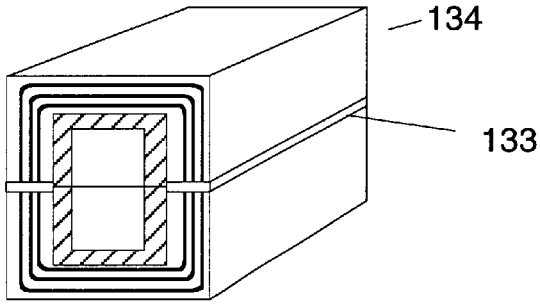
FIG. 17*b* is a view of a conceptual cross-section of an inductor with symmetric gaps in the magnetic core formed by sandwich construction.
Figure 17C:
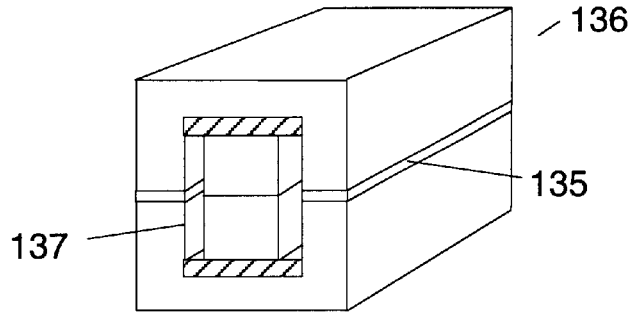
FIG. 17*c* is a view of a conceptual cross-section of an inductor with gaps in the core and air spaces in the insulator region.

FIG. 17*a* depicts an inductor 130 formed by the sandwich method. Note that the conductors 131 come into direct contact and the laminated magnetic cores 132 come into direct contact. FIG. 17*b* depicts the inductor 134 with symmetric non-magnetic, insulating gaps 133 in the magnetic core. The gap is formed with a non-magnetic, insulating material. The sandwich configuration is very convenient for the construction of a gap in the core. FIG. 17*c* depicts a inductor 136 with a gap which also utilizes an air space 137 to decrease the capacitance between the conductor and the magnetic core.

Figure 17D:
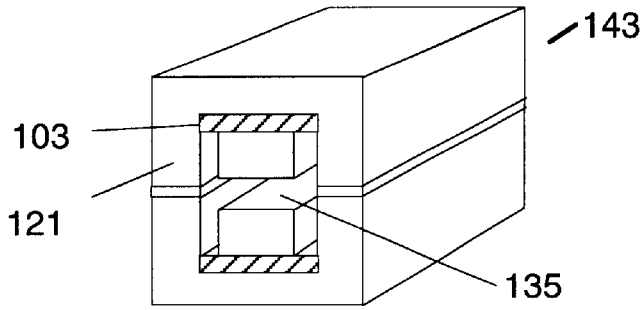
FIG. 17*d* is a view of a conceptual cross-section of an inductor with an air gap for thermal expansion. The conductors are connected externally.

FIG. 17*d* depicts an inductor 143 which is a variation on the inductor cross-section design of FIG. 17*c*. By fabricating the two halves so that the conductor does not come into contact, via an expansion space 135, the differential thermal expansion between the insulator 103 and magnetic core 121 will not produce stress on the component.

Figure 18:
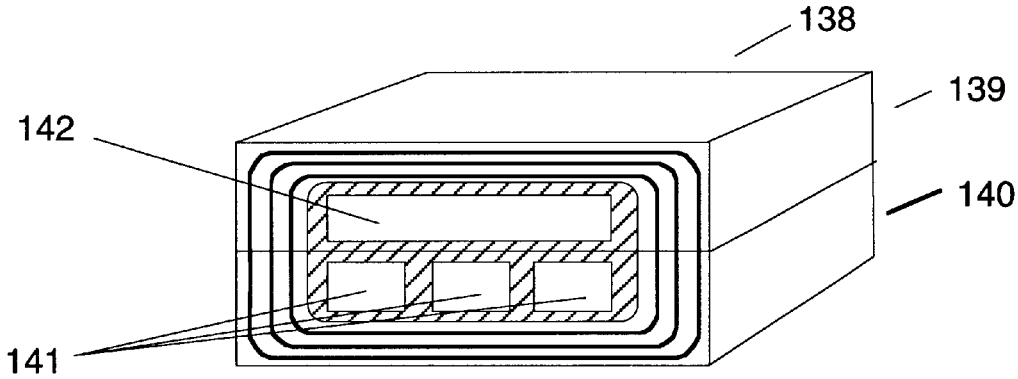
FIG. 18 is a conceptual rendition of a power splitter concept formed using sandwich construction wherein the primary is a single larger conductor and three separate, smaller conductors are secondaries; the conductor sizes are selected to match the resistive losses of the four conductors.

The sandwich construction also makes possible an alternate transformer 138 with cross-section geometries as shown in FIG. 18 in which the top 139 and bottom 140 halves have different conductor arrangements. In this case three secondaries 141 are situated in the lower half and a single much wider primary 142 is situated in the top half. This particular form is optimum for a power splitter in which the resistive losses are matched in each conductor.

A DCT having a larger secondary in the top half and the two smaller primaries in the lower half would also match the resistive power losses for that configuration. Other cross-section designs will occur to those skilled in the art.

Circular Cross Section Configuration

Figure 19:
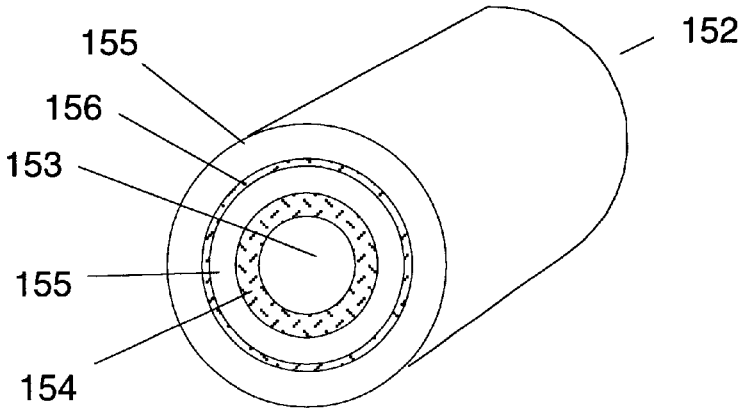
FIG. 19 is the view of a conceptual cross-section of an inductor of circular geometry having the conductor, insulator and magnetic core arranged coaxially.
Figure 20A:
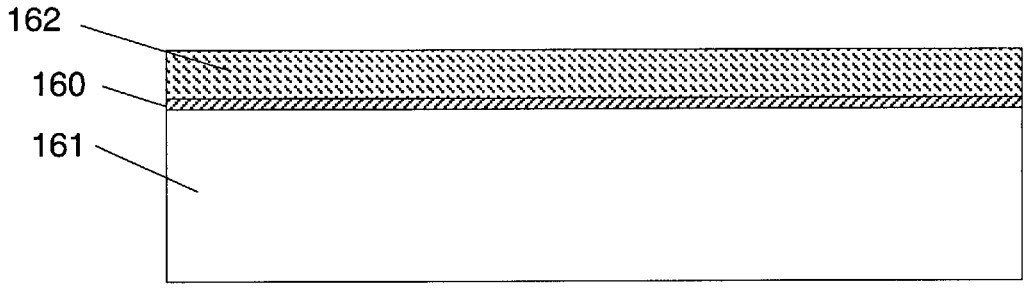
FIGS. 20*a–f* depict successive steps in a conceptual process for the fabrication of a DCT.
Figure 20B:
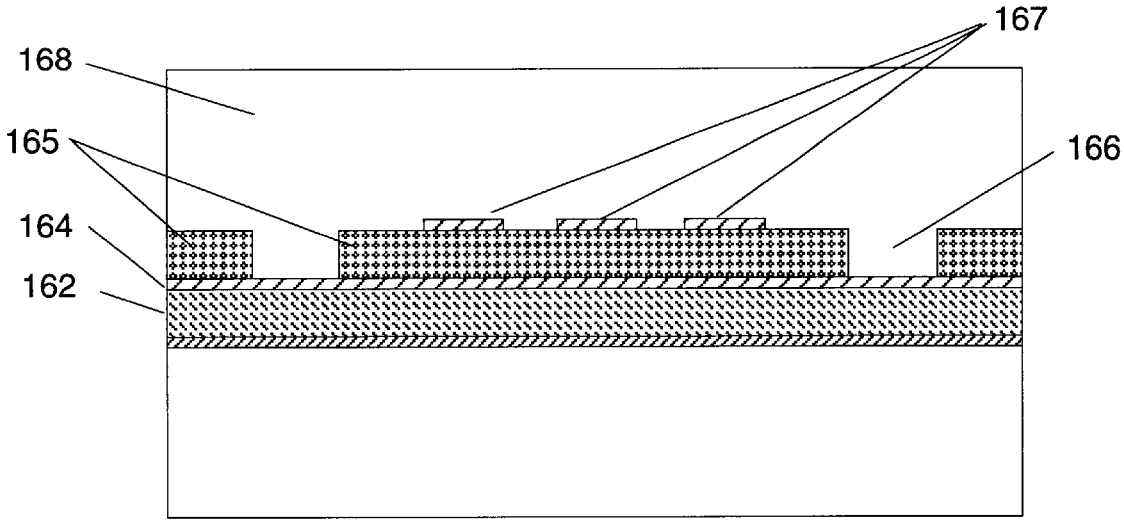
Figure 20C:
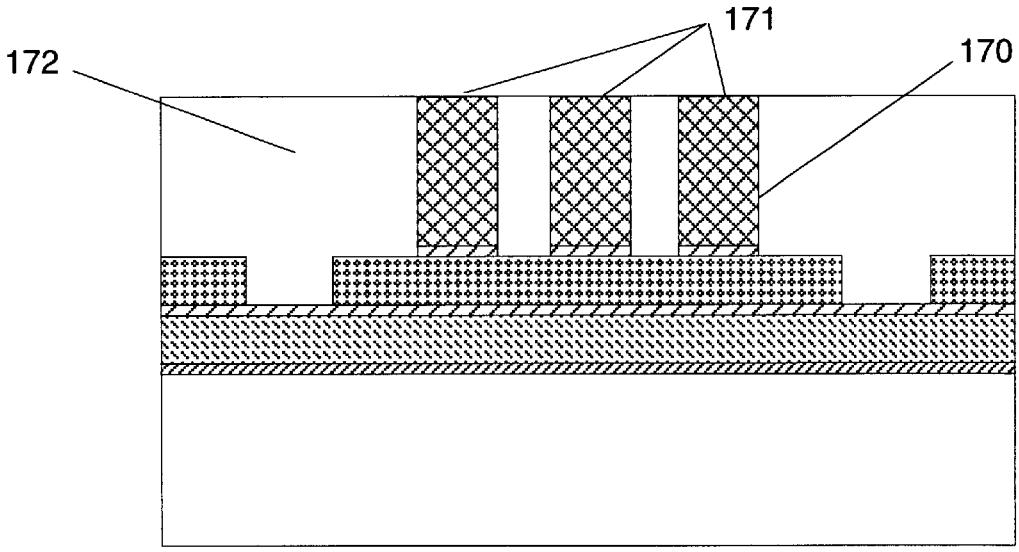
Figure 20D:
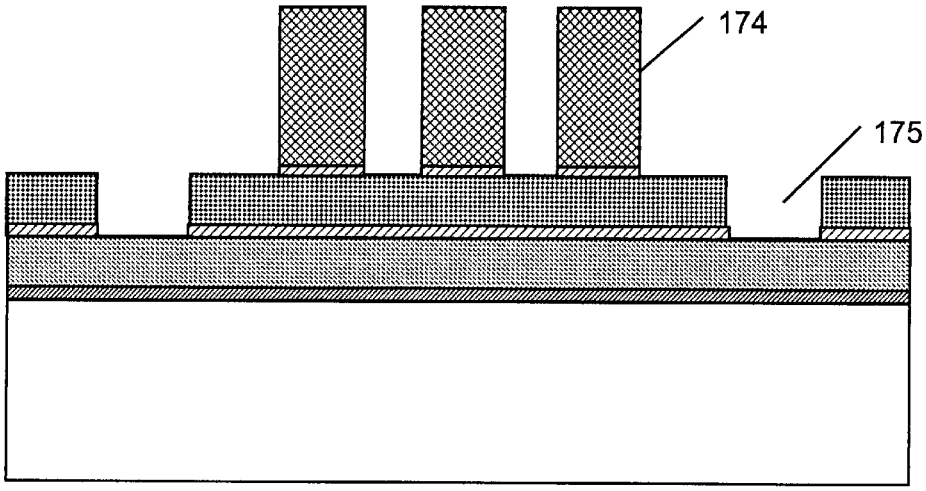
Figure 20E:
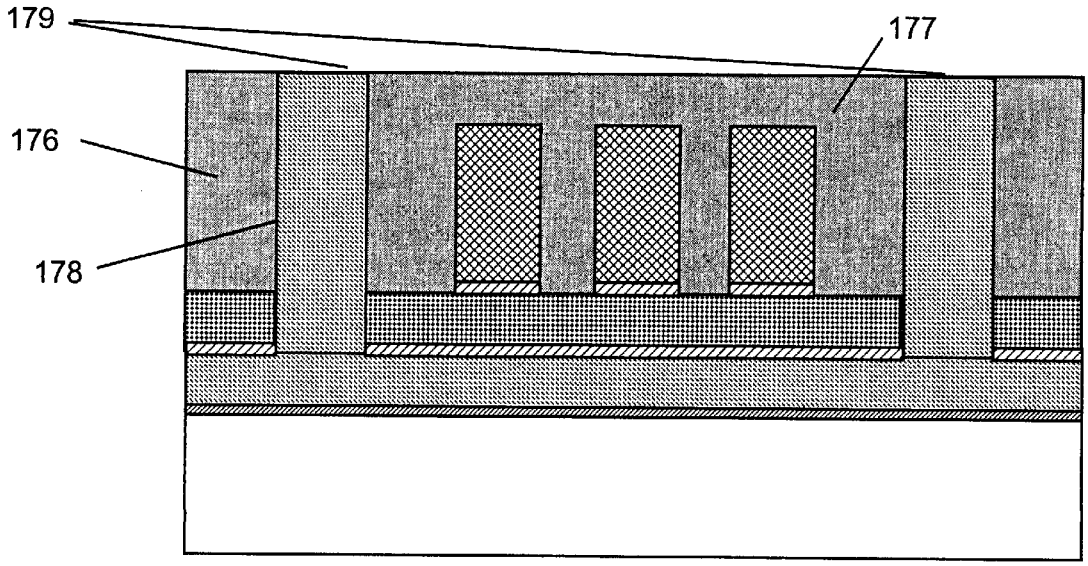
Figure 20F:
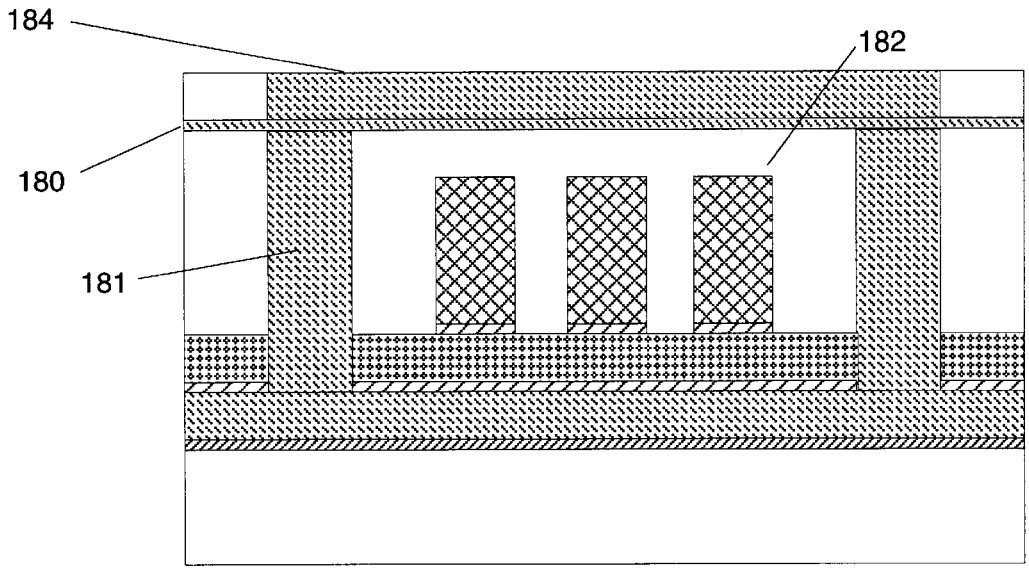
Figure 21A:
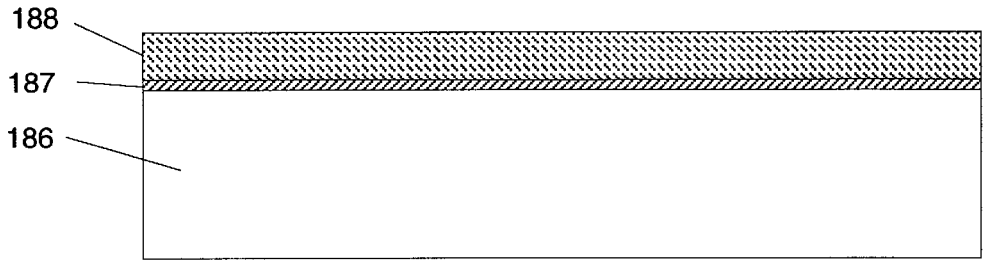
FIGS. 21*a–e* depict successive steps in a conceptual process for the fabrication of an inductor formed using sandwich construction.
Figure 21B:
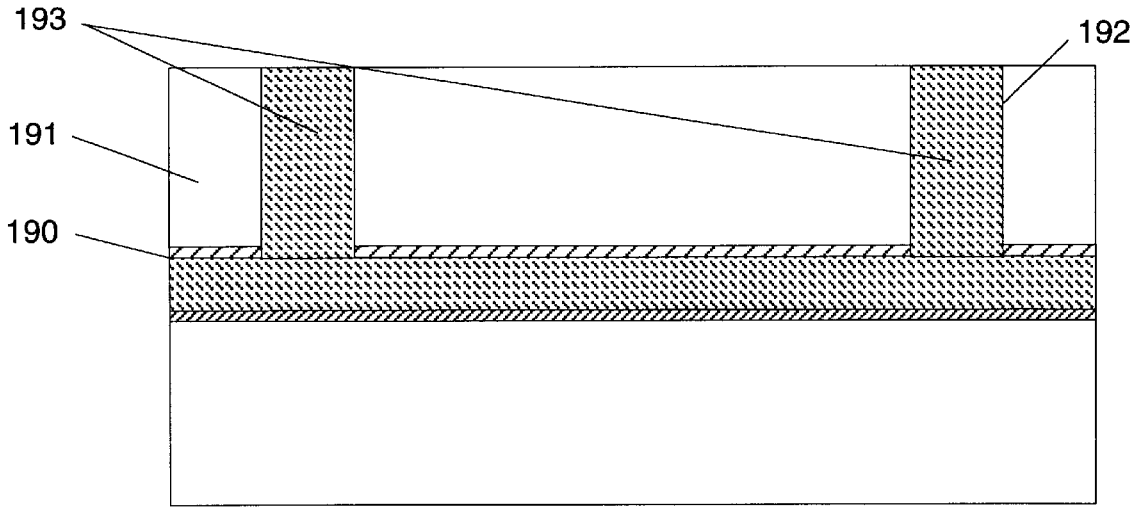
Figure 21C:
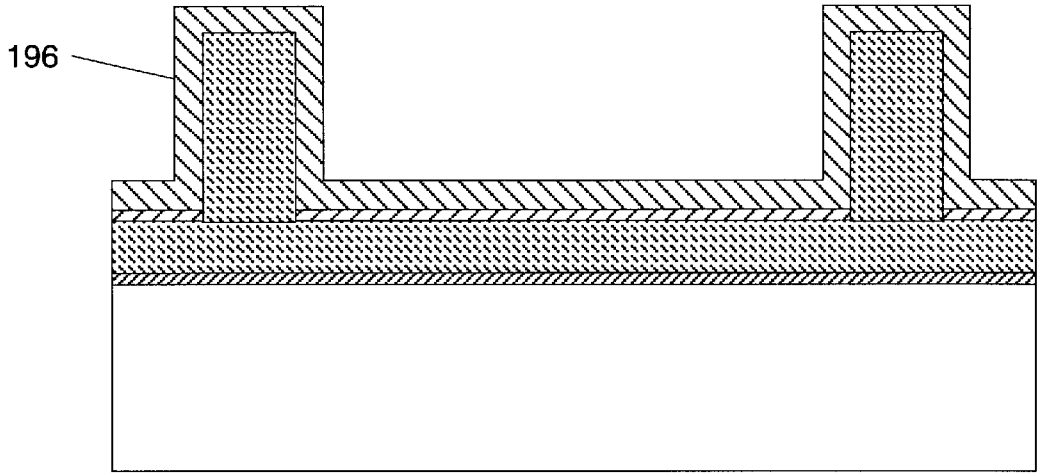
Figure 21D:
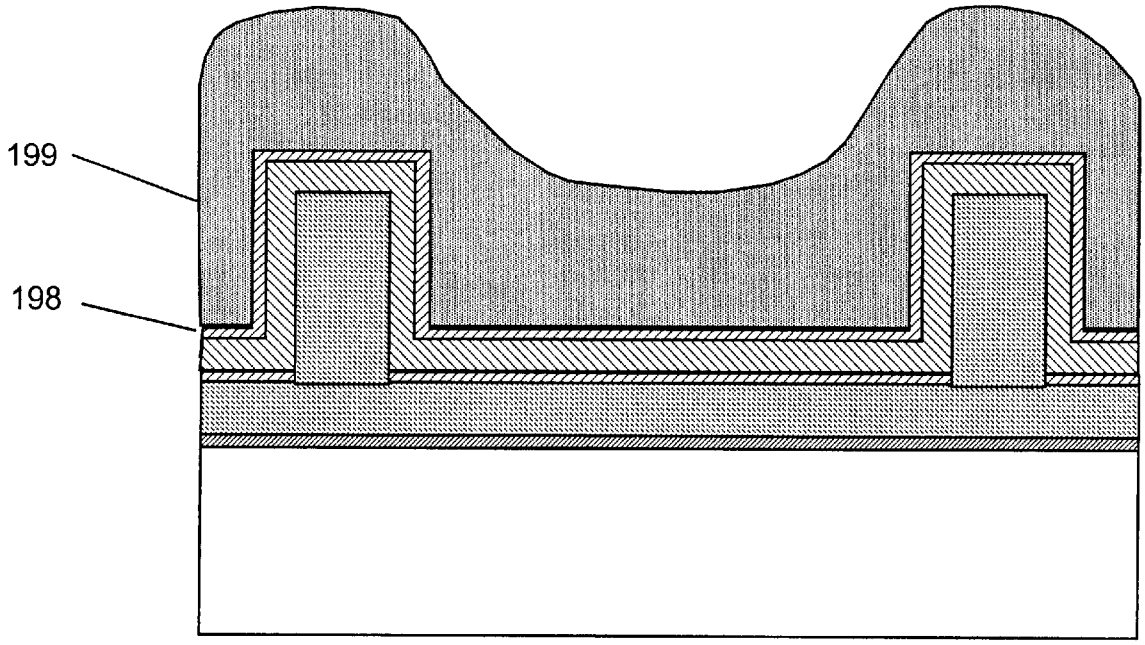
Figure 21E:
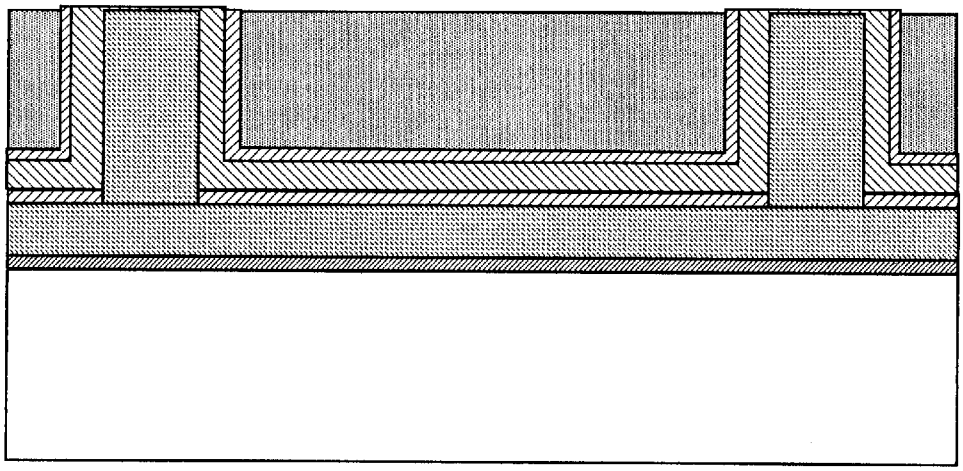

Although the cross-sections of the inductive components of the invention have been depicted as essentially rectangular, other cross-section shapes are possible, such as elliptical or round. FIG. 19 depicts an inductor with round cross section 152. A circular conductor 153 is coated with insulation 154 and subsequently coated with a magnetic core material 155 in a coaxial arrangement. A two lamination configuration is shown with non-magnetic insulating layer 156 between the two laminations.

Other useful cross-section shapes will occur to those skilled in the art.

First Fabrication Process Description

FIGS. 20*a* through 20*f* describe a process currently in use for fabricating the DCT. It can also be applied to a transformer (two conductors) and an inductor (one conductor). The non-laminated core approach will be described in the following series of steps.

Step a.

A thin film of copper 160 is sputter deposited onto a substrate 161 with the proper flatness and polish. The substrate should be a good thermal conductor. Copper is used as a sacrificial layer, which can be removed at the end of the entire process allowing the separation of the component from the substrate. A layer of magnetic material 162 is then electroplated onto the copper layer forming the bottom half of the magnetic core. The substrate can be silicon for IC integration.

Step b.

A sputtered film of titanium 164 or chromium metal is applied to the magnetic material to enhance adhesion for the following insulator material. The insulator layer 165 is then applied and patterned to allow access 166 for the magnetic core sidewalls. Onto the insulator material is then sputtered a thin layer of titanium/copper/titanium 167 which is patterned to provide seed footings in preparation for conductor plating in a later step. Lastly, a resist 168 having the thickness of the conductor is applied.

Step c.

The thick resist is patterned and developed to form deep molds 170 down to the conductor footings. After the resist is developed, the exposed titanium is stripped and the conductor material (copper) 171 is plated into the mold followed by planarization of the surface. The thick resist 172 is then stripped Step d.

The thick resist is stripped leaving the formed conductors 174 and opening access 175 to the titanium on the surface of the lower magnetic core. The titanium layer is then etched away.

Step e.

A layer of resist 176 is applied to the thickness required for the magnetic core sidewalls. The resist above and between the conductors will serve as the insulator material 177 since the resist in non-conductive electrically. The resist is then patterned and developed to form molds 178 followed by electroplating into the molds by a magnetic material 179 such as Permalloy. A planarization step follows.

Step f.

A magnetic thin film 180 is applied to the top surface connecting the sidewalls 181 and covering the insulator material 182. More plating 184 is done on top of the thin layer to form the top segment of the core.

Conformal Formation of Magnetic Core

Conformal plating is an alternate approach to the formation of the sidewalls and top surface of the magnetic core. Continuing from step e, prior to electroplating into the core sidewall molds, a thin seed layer is applied into the molds and over the insulator material. Electroplating is then carried out to form a conformal magnetic core into the sidewalls and over the insulator. The advantage to conformal construction is that alternating thicknesses of magnetic and non-magnetic materials can be applied to form magnetic laminations.

Second Fabrication Process Description

This process describes the fabrication of an inductor using one mask. FIGS. 21*a* through 21*e* describe the process steps.

Step a.

A suitable substrate 186 is selected onto which a thin film of copper 187 is deposited. Copper serves as the sacrificial layer which will allow the separation of the component from the substrate. A magnetic material 188 is then deposited onto the copper film to form the bottom segment of the core.

Step b.

A Titanium layer 190 is sputter deposited onto the copper layer for adhesion of the resist. 80 microns of resist 191 is then applied. Photo mask one (not shown) is then used to create molds 192 for the core sidewalls 193. The titanium is then etched away from the bottom of the molds to access the magnetic layer which is also plasma cleaned. A magnetic material such as Permalloy is deposited into the molds and planarized.

Step c.

The resist is stripped and a conformal coat of insulator 196 such as parylene is applied to the exposed structures.

Step d.

A titanium seed layer 198 is sputtered onto the structure. A conformal coating of conductor material 199 such as copper is plated over the structure as shown.

Step e.

Planarization is done to bring the copper and magnetic material sidewalls to the same height.

Step f.

Two halves are joined and bonded to form a sandwich construction. (Not shown)

This approach forms one half of the sandwich construction approach. After the second half is made the two are aligned using reference devices such as pins and joined. An advantage of this process is that it uses a thinner resist than in the first process described above and thereby greatly reducing the process time and cost.

General Fabrication Procedure

Other fabrication procedures will occur to those skilled in the art.

Although specific features of the invention are shown in some drawings and not others, this is not a limitation of the invention. Other embodiments will occur to those skilled in the art, and are within the scope of the following claims.

What is claimed is:

1. An elongated, open-ended, planar, generally linear electrical inductive component having a length, comprising:

at least one conductor, each conductor defining a unique conductive path;

a continuous magnetic core co-linear with all conductors along the entire component length, and completely surrounding all conductors; and an insulator separating each conductor from any other conductor and from the magnetic core;

wherein at any location along the length of the component, in cross section the component includes only one conductor for any conductive path.

2. The component of claim 1 comprising a single conductor, to accomplish an inductor.

3. The component of claim 2, wherein the magnetic core defines a magnetic circuit comprising a gap.

4. The component of claim 2, wherein the conductor defines a gap along its entire length, to create two full-length top and bottom halves, to allow for differential thermal expansion.

5. The component of claim 2 wherein the insulator is in part accomplished by a space, to reduce the component capacitance.

6. The component of claim 1 comprising two conductors, to accomplish a transformer.

7. The component of claim 1 comprising three conductors, to accomplish a differential current transformer.

8. The component of claim 1 comprising more than two conductors to accomplish a step up or step down transformer with a desired voltage transformation from the input or inputs to the output or outputs.

9. The component of claim 1 wherein the magnetic core and all conductors meander through a plurality of turns, to increase the component's effective length.

10. The component of claim 9 wherein the meanders are essentially parallel.

11. The component of claim 9, wherein the component comprises two or more stacked layers of meanders, to increase the conductor and core length.

12. The component of claim 1, wherein at least one conductor defines a gap along its entire length, to define two full-length top and bottom halves, to allow for differential thermal expansion.

13. A method of fabricating the component of claim 1, comprising:

fabricating two essentially identical halves, each defining one half of the component; and mechanically and magnetically coupling together the two halves, to create the component.

14. The component of claim 1, wherein the magnetic core comprises a plurality of laminations separated by non-magnetic insulating material, each lamination completely surrounding all of the conductors.

15. The component of claim 1, wherein the component directly connects between two spaced components in an electrical circuit, to both accomplish a desired inductance as well as carry current between the two spaced components.

16. A multiple inductive component inductive circuit comprising a plurality of inductive components of claim 1 connected in a desired series and/or parallel circuit combination, to achieve a desired inductance value or voltage conversion.

17. A method of fabricating an elongated, open-ended, planar, generally linear electrical inductive component having a length by multi-layered fabrication, the component having at least one conductor, each conductor in the component defining a unique conductive path, a continuous magnetic core co-linear with all conductors along the entire component length, and completely surrounding all conductors, and an insulator separating each conductor from any other conductor and all conductors from the magnetic core, wherein at any location along the length of the component, in cross section the component includes only one conductor for any conductive path, the method comprising:

providing a lower layer of magnetic core material;

providing on top of the lower layer of magnetic core material, a bottom insulator layer;

providing on top of the bottom insulator the at least one conductor;

providing an insulator adjacent to the outside and top of each conductor;

providing, spaced to the outside of the at least one conductor and the adjacent insulator, vertical segments of the magnetic core, in contact with the lower layer of magnetic core material; and providing over the upper insulator and in contact with the magnetic core vertical segments, an upper magnetic core material, to complete a magnetic core circuit.

18. The method of claim 17 wherein the component comprises a single conductor, to accomplish an inductor.

19. The method of claim 18, wherein the magnetic core defines a circuit comprising a gap.

20. The method of claim 17 comprising three conductors, to accomplish a differential current transformer.

21. The method of claim 17 comprising more than two conductors to accomplish a step up or step down transformer with a desired voltage transformation from the input or inputs to the output or outputs.

22. The method of claim 17 wherein the magnetic core and all conductors meander through a plurality of turns, to increase the component's effective length.

23. The method of claim 17, wherein the magnetic core comprises a plurality of laminations separated by non-magnetic insulating material, each lamination completely surrounding all of the conductors.

24. The method of claim 17, wherein at least one conductor defines a gap along its entire length, to create two full-length top and bottom halves, to allow for differential thermal expansion.

25. The method of claim 18, wherein the conductor defines a gap along its entire length, to define two full-length top and bottom halves, to allow for differential thermal expansion.

26. The method of claim 17 comprising two conductors, to accomplish a transformer.

27. The method of claim 18 wherein the insulator is in part accomplished by a space, to reduce the component capacitance.

28. A method of fabricating an elongated, open-ended, planar, generally linear electrical inductive component having a length by multi-layered fabrication, the component having at least one conductor, each conductor in the component defining a unique conductive path, a continuous magnetic core co-linear with all conductors along the entire component length, and completely surrounding all conductors, and an insulator separating each conductor from any other conductor and all conductors from the magnetic core, wherein at any location along the length of the component, in cross section the component includes only one conductor for any conductive path, the method comprising:

a. fabricating two component halves, each half made by:

providing a lower layer of magnetic core material;

providing on top of the lower layer of magnetic core material, a bottom insulator layer;

providing on top of the bottom insulator layer the at least one conductor;

providing an insulator adjacent to the outside of each conductor;

providing, spaced to the outside of the at least one conductor and the adjacent insulator, vertical segments of the magnetic core, in contact with the lower layer of magnetic core material; and planarizing the top surface; and then b. mechanically and magnetically coupling together the planarized surfaces of the two halves, to complete the component.

29. The method of claim 28 wherein the component comprises a single conductor, to accomplish an inductor.

30. The method of claim 29, wherein the magnetic core defines a magnetic circuit comprising a gap.

31. The method of claim 29, wherein the conductor defines a gap along its entire length, to create two full-length top and bottom halves, to allow for differential thermal expansion.

32. The method of claim 29 wherein the insulator is in part accomplished by a space, to reduce the component capacitance.

33. The method of claim 28 wherein the magnetic core and all conductors meander through a plurality of turns, to increase the component's effective length.

34. The method of claim 28, wherein the magnetic core comprises a plurality of laminations separated by non-magnetic insulating material, each lamination completely surrounding all of the conductors.

35. The method of claim 28, wherein at least one conductor defines a gap along its entire length, to define two full-length top and bottom halves, to allow for differential thermal expansion.

36. The method of claim 28 comprising two conductors, to accomplish a transformer.

37. The method of claim 28 comprising three conductors, to accomplish a differential current transformer.

38. The method of claim 28 comprising more than two conductors to accomplish a step up or step down transformer with a desired voltage transformation from the input or inputs to the output or outputs.

39. A method of fabricating an elongated, open-ended, planar, generally linear electrical inductor having a length by multi-layered fabrication, the inductor having a single conductor, a continuous magnetic core co-linear with the conductor along the entire component length, and completely surrounding the conductor, and an insulator separating the conductor from the magnetic core, the method comprising:

a. fabricating two component halves, each half made by:
   providing a lower layer of magnetic core material;
   providing spaced vertical segments of the magnetic core, in contact with the lower layer of magnetic core material;
   providing a bottom insulator layer on top of the lower layer of magnetic core material and the spaced vertical segments;
   providing the conductor on top of the insulator; and then planarizing the top surface; and b. mechanically and magnetically coupling together the planarized surfaces of the two halves, to complete the component.

40. The method of claim 39, wherein the magnetic core defines a magnetic circuit comprising a gap.

41. The method of claim 39, wherein the conductor defines a gap along its entire length, to create two full-length top and bottom halves, to allow for differential thermal expansion.

42. The method of claim 39, wherein the conductor defines a gap along its entire length, to define two full-length top and bottom halves, to allow for differential thermal expansion.

43. The method of claim 39 wherein the magnetic circuit and the conductor meanders through a plurality of turns, to increase the component's length.

44. The method of claim 43, wherein the magnetic circuit comprises a plurality of laminations separated by non-magnetic insulating material, each lamination completely surrounding the conductor.

45. The method of claim 39 wherein the insulator is in part accomplished by a space, to reduce any capacitance of the component.

46. A method of fabricating an elongated, open-ended, planar, generally linear electrical inductor having a length by multi-layered fabrication, the inductor having a single conductor, a continuous magnetic core co-linear with the conductor along the entire component length, and completely surrounding the conductor, and an insulator separating the conductor from the magnetic core, the method comprising:

providing an elongated conductive wire having an essentially circular cross-section;

coating the wire with a non-magnetic insulation layer; and coating the non-magnetic insulation layer with a first layer of magnetic core material.

47. The method of claim 46, further comprising creating a plurality of laminations in the magnetic core by sequentially coating the first layer of magnetic core material with one or more laminations, each comprising a coating of non-magnetic insulating material and then a coating of magnetic core material on top of the coating of non-magnetic insulating material.

* * * * *